United States Patent [19]

Reiland

[11] Patent Number: 4,526,338

[45] Date of Patent: Jul. 2, 1985

[54] HIGH PRESSURE MOLDING RISER

[75] Inventor: Dennis J. Reiland, Roseville, Minn.

[73] Assignee: General Foundry Products Corporation, Blaine, Minn.

[21] Appl. No.: 602,904

[22] Filed: Apr. 23, 1984

[51] Int. Cl.[3] ..... B22C 9/08

[52] U.S. Cl. ..... 249/197; 249/198; 164/360

[58] Field of Search ..... 249/197, 198, DIG. 5; 264/244, 359, 360

[56] References Cited

U.S. PATENT DOCUMENTS

| | | | |
|---|---|---|---|
| 3,177,537 | 4/1965 | Horton | 164/244 X |
| 3,256,571 | 6/1966 | Lund | 164/244 X |
| 3,815,665 | 6/1974 | Baur | 164/359 |
| 4,188,010 | 2/1980 | Reiland | 164/359 X |
| 4,423,762 | 1/1984 | Trinkl et al. | 164/244 X |

FOREIGN PATENT DOCUMENTS

| | | | |
|---|---|---|---|
| 404541 | 7/1974 | U.S.S.R. | 164/244 |
| 546423 | 4/1977 | U.S.S.R. | 164/244 |

*Primary Examiner*—J. Howard Flint, Jr.

*Attorney, Agent, or Firm*—Jacobson and Johnson

[57] ABSTRACT

A casting riser including a top support member and an internal support member to receive the high pressure molding forces to enable the casting riser to withstand the high pressure molding forces.

7 Claims, 2 Drawing Figures

HIGH PRESSURE MOLDING RISER

FIELD OF THE INVENTION

This invention relates generally to foundry articles and, more specifically, to improvements to riser sleeves for use in high pressure molding machines.

DESCRIPTION OF THE PRIOR ART

Foundry cast articles are well known in the art. Typically, one pours molten metal into a sand mold cavity where the molten metal gradually cools and solidifies. Because the volume of molten metal shrinks as it cools, it is necessary to provide a reservoir of molten metal adjacent the cavity so that molten metal can continue to flow into the cavity and fill the shrinkage voids in the casting. The reservoir of molten metal is held in an insulative container known as a riser.

The concept of risers for use in sand molds is well known in the art. One such open top riser is shown in my U.S. Pat. No. 4,188,010.

Russian Pat. No. 5,464,223 shows the use of a gating funnel pattern for mold production.

Russian Pat. No. 404,541 shows a metal rod for attachment to a molding board.

Horton U.S. Pat. No. 3,177,537 shows a sprue form of aluminum for use in forming investment molds.

The Lund U.S. Pat. No. 3,256,571 shows apparatus and method for making a mold cavity.

The Baur U.S. Pat. No. 3,815,665 shows a closed top riser formed of refractory materials such as quartz glass, magnesium oxide, or fibers of kaolin or fibers of burned magnesite and an insulative layer of foamed plastic or the like which is placed outside the refractory material.

One of the problems with closed top risers which are made of insulative materials is that they usually do not have the structural strength to withstand the forces generated by the high pressure molding presses (up to 2,000 PSI). There have been a number of prior art attempts to provide a riser that can withstand the high pressure encountered in the molding machines. One of the first attempts comprised a dome shaped sleeve in which a metal pin was inserted through a hole in the top of the dome to prevent tipping of the riser. The dome shaped sleeve included a ceramic core which extended radially out from the side of the pin to the inside side wall of the riser. A disadvantage of the dome shaped sleeve was that besides frequent sleeve collapse the sleeve core separated from the sleeve resulting in scarring on the casting in the regions where the sleeve and the core joined each other.

A second embodiment used a similar design which included a sand core that extended under the ends of the riser side wall with the sand core glued to the riser side walls. This embodiment had the disadvantage in that it was difficult to obtain adherence of the sand core to the riser side walls. In addition, the sleeves frequently collapsed during the high pressure molding process.

A third embodiment comprised a tapered or frusto conical riser sleeve that smoothly tapered to a flat top. This tapered sleeve was also subject to collapsing during the high pressure molding process.

A further embodiment also used a tapered riser sleeve with a flat top but a high density material such as a ceramic was used to make the riser and thereby provide greater structural strength. A metal support pin was used to support the ceramic portion of the flat top; however, as the sleeve compressed during the molding process it caused the cores to break off the riser as well as being subject to collapsing during the high pressure molding process.

A further embodiment comprised a modification of the flat top insulated riser by placing a bevelled side at the junction of the tapered walls with the flat top; however, it too collapsed during the molding process.

A further embodiment of the above design added corner supports between the core and the side walls; however, it also failed frequently.

In a further embodiment the sleeve was dipped into a sodium silicate solution to provide a case or crust hardening of the sleeve; however, in spite of the crust hardening the sleeve frequently collapsed.

BRIEF DESCRIPTION OF THE INVENTION

Figure 1:
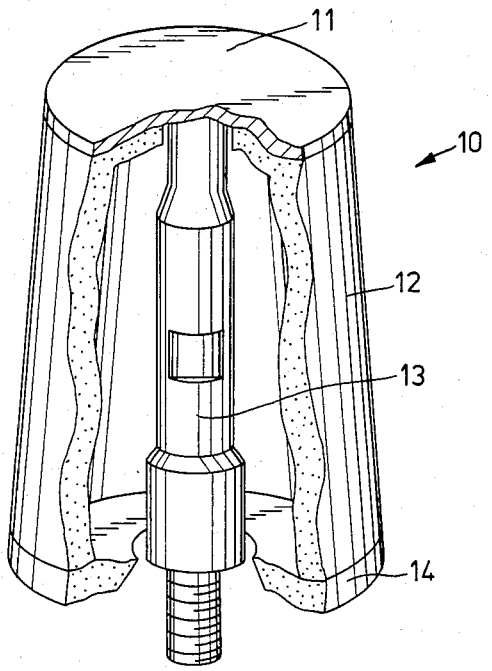
FIG. 1 is a cross sectional cut-away view showing my riser and a supporting pin therein.
Figure 2:
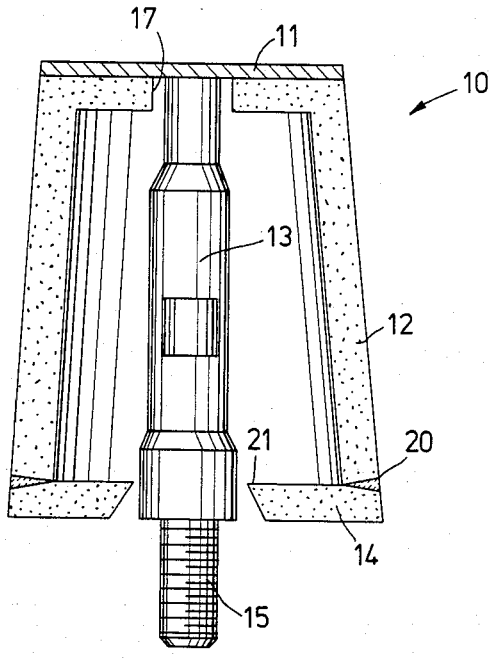
FIG. 2 is a cross sectional view showing the riser and the supporting pin.

Briefly, the invention comprises a riser having an external support surface and an internal support pin which fastens to a pattern to prevent the riser from collapsing during the high pressure molding process.

DESCRIPTION OF THE PREFERRED EMBODIMENT

Referring to the drawing, reference numeral 10 generally identifies the high pressure molding riser of the present invention comprising a circular top support member or plate 11 which is fastened with an adhesive to the top surface of a frusto conical riser 12 having a central opening 17. Located at the bottom of high pressure molding riser 10 is a circular shaped core 14 which is fastened to the underside of the side walls of riser 12 with an adhesive 20. Riser 12 may be made from material such as silica and alumina or other materials which would crush or break if subjected to the high pressure molding forces. Core 14 may be made from materials such as ceramics or the like. A central metal support pin 13 such as steel or the like extends through core 14 and through opening 17 in the top of riser 12. Top support plate or cap 11 which is fastened to the top of riser 12 by an adhesive or the like comprises a circular shaped metal plate of sufficient size to cover the flat top of riser 12 to thereby form an external support surface that can transmit high pressure molding forces on the top of riser 12 to pin 13 rather than to riser 12 thereby avoiding the usual fracturing or breaking of riser 12 in the high pressure molding process.

In the preferred embodiment metal such as steel is used as the support plate since it has sufficient structural strength to withstand the high pressure molding forces; however, other materials of suitable strength and rigidity could also be used. The criteria being that the plate must withstand forces over the entire surface without bending or deforming sufficiently to cause fracturing of the riser located beneath the cap.

Located beneath the central portion of cap 11 is pin 13 which has one end in contact with the underside of cap 11 and the opposite end having a threaded section 15 for engagement with a pattern. That is, pin 15 is fastened to a pattern (not shown) which provides a support surface for pin 13. Since cap 11 is in contact with the top of pin 13 any compressive forces exerted on the cap 11 are directed to the top end of pin 13 and then distributed to the pattern through pin 13. It will be appreciated that very little of the compressive forces are actually transmitted to the riser 12 since the pin 13 and cap 11 are made from materials that have sufficient strength to withstand the compressive forces occurring in the high pressure molding process. Thus, the riser 12 which is generally preferred to be made of a crushable or breakable material such as silica and alumina does not have to provide all the structural support for riser 12 since a large portion or substantially all the forces on cap 11 are transmitted to pin 13 and the pattern (not shown).

Core 14 which is fastened to the riser walls has a conical tapered opening with a top lip 21 that extends inward toward pin 13. A slight spacing permits alignment of pin 13 as well as prevent the core from breaking due to movement of riser 12.

I claim:

1. A riser for inserting into a mold, said riser formed of a material breakable under the high pressure forces encountered in a molding machine;

a top surface on said riser;

a support member located on said top surface of said riser, said support member having an area operable to engage a support pin so that when a force is applied to said support member at least part of the force is transmitted to said support pin to thereby prevent breakage of the riser formed of the breakable material when the riser is subjected to the high pressure forces encountered in a molding machine.

2. The invention of claim 1 wherein said riser has a frusto conical shape and includes a core.

3. The invention of claim 2 wherein said riser has a central conical tapered opening.

4. The invention of claim 1 wherein said support member comprises a plate that extends completely across the top surface of said riser.

5. The invention of claim 4 wherein said support member is metal.

6. The invention of claim 5 wherein said support member has a central area for engaging a support pin.

7. The invention of claim 1 including a support pin having means on one end for attachment to a pattern and a surface on the opposite end for engagement with said support member.

* * * * *